US007770355B2

(12) United States Patent
Inamura

(10) Patent No.: US 7,770,355 B2
(45) Date of Patent: Aug. 10, 2010

(54) MEDICINE FEEDING DEVICE

(75) Inventor: Atsuo Inamura, Ota (JP)

(73) Assignee: Sanyo Electric Co., Ltd., Moriguchi, Osaka (JP)

( * ) Notice: Subject to any disclaimer, the term of this patent is extended or adjusted under 35 U.S.C. 154(b) by 1673 days.

(21) Appl. No.: 10/669,393

(22) Filed: Sep. 23, 2003

(65) Prior Publication Data

US 2004/0084512 A1 May 6, 2004

(30) Foreign Application Priority Data

Sep. 27, 2002 (JP) ..... 2002-283863
Sep. 27, 2002 (JP) ..... 2002-283874
Sep. 27, 2002 (JP) ..... 2002-283900
Sep. 27, 2002 (JP) ..... 2002-283920
Sep. 27, 2002 (JP) ..... 2002-283947

(51) Int. Cl.
*B65B 61/26* (2006.01)

(52) U.S. Cl. ..... 53/131.5; 53/131.4

(58) Field of Classification Search ..... 53/131.5, 53/551, 131.4, 552, 411, 451, 139.2, 373.6
See application file for complete search history.

(56) References Cited

U.S. PATENT DOCUMENTS 5,661,948 A * 9/1997 Odenthal ..... 53/131.5
5,722,215 A * 3/1998 Yuyama ..... 53/374.4
5,768,852 A * 6/1998 Terminella et al. ..... 53/133.4
5,787,678 A * 8/1998 Koike et al. ..... 53/154
5,839,257 A * 11/1998 Soderstrom et al. ..... 53/411
5,875,610 A * 3/1999 Yuyama et al. ..... 53/75
6,041,574 A * 3/2000 Bennett ..... 53/411
6,047,521 A * 4/2000 Terminella et al. ..... 53/133.4
6,935,086 B2 * 8/2005 Brenkus et al. ..... 53/411
7,228,988 B2 * 6/2007 Inamura ..... 221/65
7,395,944 B2 * 7/2008 Inamura ..... 221/65
2003/0009989 A1 * 1/2003 Knoerzer et al. ..... 53/451

FOREIGN PATENT DOCUMENTS

JP 08-011805 A 1/1996

* cited by examiner

*Primary Examiner*—Sameh H. Tawfik
(74) *Attorney, Agent, or Firm*—Westerman, Hattori, Daniels & Adrian, LLP

(57) ABSTRACT

There is provided a medicine feeding device which can apply uniform tension to wrapping paper wound in a roll state to wrap a medicine. The medicine feeding device comprises a tablet case which stores a medicine, and the wrapping paper wound in the roll state, wraps a medicine discharged from the tablet case in wrapping paper 72, and comprises a tension application mechanism 113 which applies predetermined tension to the continuously pulled-out wrapping paper. This tension application mechanism is constituted to freely move up-and-down, and to apply tension to the pulled-out wrapping paper by its own weight.

2 Claims, 17 Drawing Sheets

MEDICINE FEEDING DEVICE

BACKGROUND OF THE INVENTION

The present invention relates to a medicine feeding device which wraps medicines stored in tablet cases as much as an amount specified in accordance with a prescription at a hospital or a dispensing pharmacy.

Conventionally, at the hospital or the dispensing pharmacy, the medicine feeding device (tablet wrapping machine) has been used to provide medicines prescribed by a doctor. According to this system, the amount of medicines (tablets, capsules or the like) described in a prescription is discharged from a discharge drum (alignment board) in tablet cases (tablet storing and feeding members) one by one, and collected by a hopper. Then, wrapping paper (medical sheet) wound in a roll state is pulled out, use/purpose is printed on the wrapping paper by a printer, and then each is wrapped (e.g., see Japanese Patent Application Laid-Open No. 8 (1996)-11805).

In the case of wrapping a medicine by pulling out the wrapping paper wound in the roll state, proper tension is applied to prevent the occurrence of wrinkles. According to a conventional method for applying tension, an arm rotated and pressed by a coil spring is used, and the wrapping paper is hooked on a rod disposed on the tip of the arm to apply tension.

In such a case, as a pressing force of the coil spring is changed depending on a rotational angle of the arm, the tension applied to the wrapping paper is also changed. Wrinkles occur if this tension is too small. If too large conversely, there is a danger of cutting the wrapping paper.

In a nozzle for discharging/feeding a medicine to the wrapping paper, a shutter is disposed to control the feeding of the medicine by opening/closing a medicine dropping passage in the nozzle. On the other hand, the medicine dropping passage in the nozzle is constituted to have a narrow outlet to enable feeding of even shallow (small-width) wrapping paper. Consequently, when a medicine of a long capsule is discharged, there is a problem of clogging of the nozzle by the medicine.

The wrapping paper wound in the roll state is normally V-shaped roughly in section in which an upper surface is open and a lower end is folded (half-folding), and the nozzle is inserted into the wrapping paper from above. Slackening or wrinkles occur depending on a dimension of the nozzle to cause a problem of wrapping state failures.

In the case of pulling out the wrapping paper wound in the roll state to wrap the medicine therein, the roll of the wrapping paper is mounted on a wrapping paper delivery mechanism which is constituted of a base plate and an engaging shaft. In this case, the roll is mounted in the form of inserting the engaging shaft into a shaft tube of the roll of the wound wrapping paper. However, since a tensile force is applied to the roll when the wrapping paper is pulled out, the shaft tube may be disengaged from the engaging shaft. Thus, while falling-off can be prevented by making the engaging shaft longer, there is a problem of difficult mounting work.

Furthermore, in the case of pulling out the wrapping paper wound in the roll state, printing and wrapping the medicine, thermal-transfer printing which uses an ink ribbon is ordinarily utilized. However, in the medicine feeding device of this kind, since the printer is attached to a very narrow place on the midway of the wrapping machine, mounting of the ink ribbon becomes very difficult. Especially, when a wide ink ribbon is mounted, there is a problem of wrinkles or winding shifting.

The present invention is designed to solve the foregoing conventional technical problems, and to provide a medicine feeding device which can apply uniform tension to wrapping paper wound in a roll state to wrap a medicine.

The present invention provides a medicine feeding device which can effectively eliminate medicine-clogging of a nozzle for discharging a medicine to wrapping paper.

The present invention provides a medicine feeding device structured in such a manner that occurrence of slacking or wrinkles is difficult on wrapping paper by a nozzle.

The present invention provides a medicine feeding device which improves mounting workability while effectively eliminating inconvenient falling-off of wrapping paper wound in a roll state from a wrapping paper delivery mechanism.

The present invention provides a medicine feeding device which comprises a fixture for facilitating mounting of an ink ribbon on a printer which prints on wrapping paper wound in a roll state to wrap a medicine.

SUMMARY OF THE INVENTION

A first aspect of the present invention is directed to a medicine feeding device which comprises a tablet case for storing a medicine and wrapping paper wound in a roll state and which wraps the medicine discharged from the tablet case in the wrapping paper, the medicine feeding device comprising a tension application mechanism for applying predetermined tension to the continuously pulled-out wrapping paper, the tension application mechanism being constituted to be upward and downward movable, and applying tension to the pulled-out wrapping paper by its own weight.

A second aspect of the present invention is directed to the medicine feeding device, wherein the tension application mechanism comprises an operation section for depressing the wrapping paper, a roller disposed in the operation section, and a vertical rail with which the roller is slidably engaged.

A third aspect of the present invention is directed to a medicine feeding device for feeding a medicine discharged from a tablet case for storing the medicine, comprising a nozzle for releasing the medicine discharged from the tablet case; and a shutter rotatably disposed in the nozzle to open/close a medicine dropping passage in the nozzle, wherein the shutter comprises a first shutter plate which has a dimension capable of closing the nozzle and which is rotated, and a second shutter plate swingingly connected to a tip of the first shutter plate.

A fourth aspect of the present invention is directed to the medicine feeding device, wherein an outlet of the medicine dropping passage in the nozzle is narrowed as compared with an inlet, and as the first shutter plate is rotated, the second shutter plate abuts on a narrow place of the medicine dropping passage in the nozzle to be swung.

A fifth aspect of the present invention is directed to a medicine feeding device which comprises a tablet case for storing a medicine and wrapping paper wound in a roll state and wrapping paper wound in a roll state while an upper surface is opened and a lower end is folded and which wraps the medicine discharged from the tablet case in the wrapping paper, the medicine feeding device comprising a nozzle inserted into the continuously pulled-out wrapping paper from above to feed the medicine discharged from the tablet case into the wrapping paper, a tip of the nozzle being provided with a tapered guide through which the medicine can be passed.

A sixth aspect of the present invention is directed to the medicine feeding device, wherein the nozzle is slidable to a far side of the upper surface.

A seventh aspect of the present invention is directed to a medicine feeding device which comprises a tablet case for storing a medicine and wrapping paper wound in a roll state and which wraps the medicine discharged from the tablet case in the wrapping paper, the medicine feeding device comprising a wrapping paper delivery mechanism which delivers the wrapping paper, wherein the wrapping paper delivery mechanism has a base plate for holding the wrapping paper, and an engaging shaft projected from a center of the base plate to be engaged with a shaft tube around which the wrapping paper is wound, and an engaging projection is formed on a side face of the engaging shaft, the engaging projection being inclined so as to intersect an axial direction of the engaging shaft at a predetermined angle, and an engaging groove is formed on an inner surface of the shaft tube, the engaging groove being inclined so as to engage with the engaging projection.

An eighth aspect of the present invention is directed to the medicine feeding device, wherein the engaging projection is extended from a tip of the engaging shaft toward the base plate while being inclined in a rotational direction of the engaging shaft.

A ninth aspect of the present invention is directed to the medicine feeding device, wherein the wrapping paper delivery mechanism is disposed so that the engaging shaft may be projected in a horizontal direction or in an oblique upper direction, a guide plate is disposed which receives the wrapping paper corresponding to a bottom portion of the base plate, and the tip of the engaging shaft is tapered.

A tenth aspect of the present invention is directed to a medicine feeding device which comprises a tablet case for storing a medicine, wrapping paper wound in a roll state and a printer for printing on the wrapping paper by thermal transfer using an ink ribbon and which wraps the medicine discharged from the tablet case in the wrapping paper, the medicine feeding device comprising an ink ribbon mounting fixture which has a feeding side shaft and a winding side shaft arranged in a fixture main body in a positional relation corresponding to an ink ribbon feeding side bobbin and an ink ribbon winding side bobbin of the printer in a state of being opposite the printer, the feeding side of the ink ribbon being detachably attached to the feeding side shaft, the winding side of the ink ribbon being detachably attached to the winding side shaft.

An eleventh aspect of the present invention is directed to the medicine feeding device, wherein the fixture main body is provided with a guide shaft on which the ink ribbon is hooked in a state where the feeding side of the ink ribbon is attached to the feeding side shaft and the winding side of the ink ribbon is attached to the winding side shaft.

A twelfth aspect of the present invention is directed to the medicine feeding device, wherein the feeding side shaft and the winding side shaft are held by the fixture main body so as to be movable in a direction exiting from the feeding side and the winding side of the ink ribbon in a state of abutting on the ink ribbon feeding side bobbin and the ink ribbon winding side bobbin.

DETAILED DESCRIPTION OF THE PREFERRED EMBODIMENT

Figure 1:
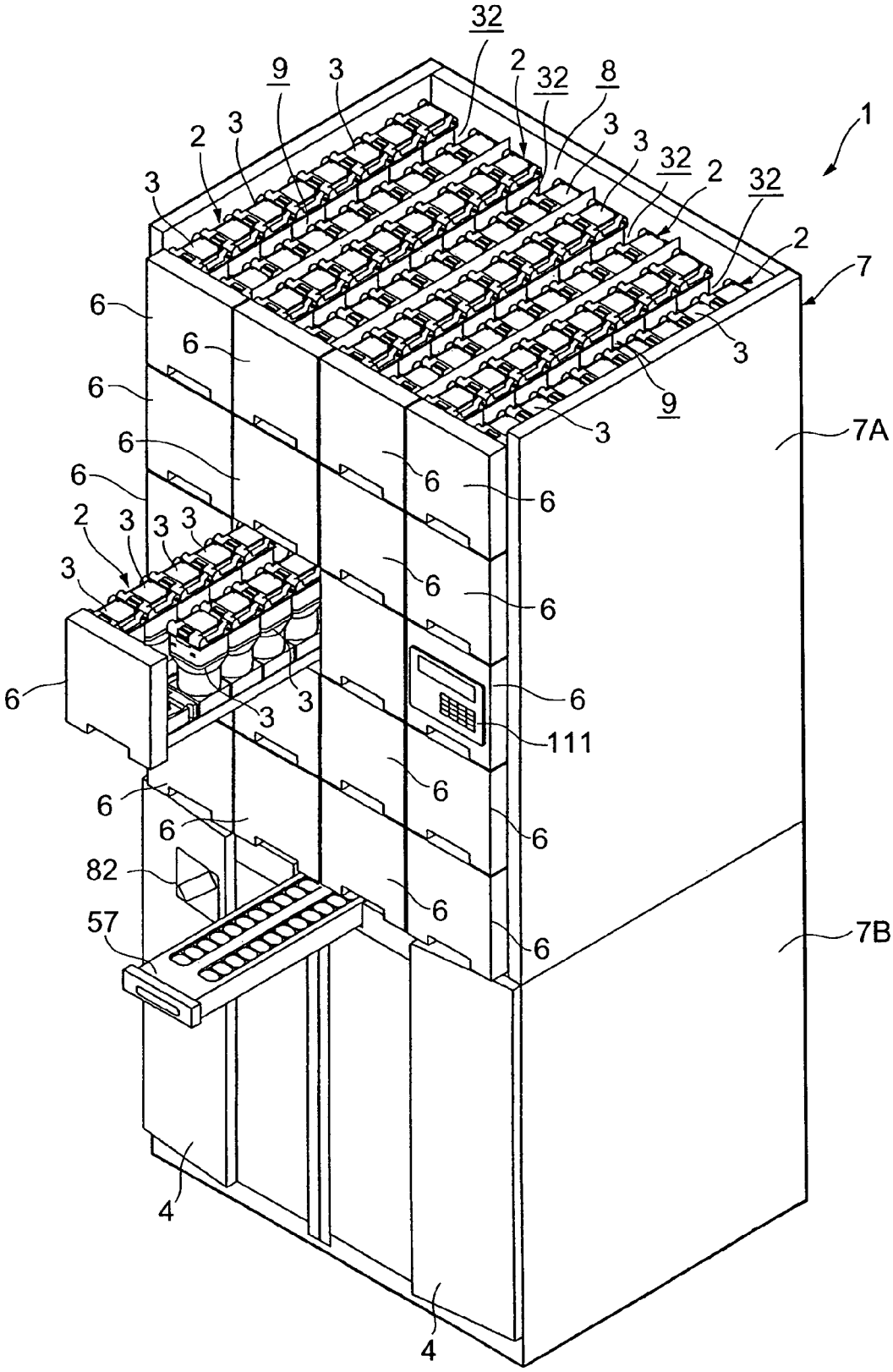
FIG. 1 is a perspective view of a medicine feeding device (excluding a top plate) according to an embodiment of the present invention.
Figure 2:
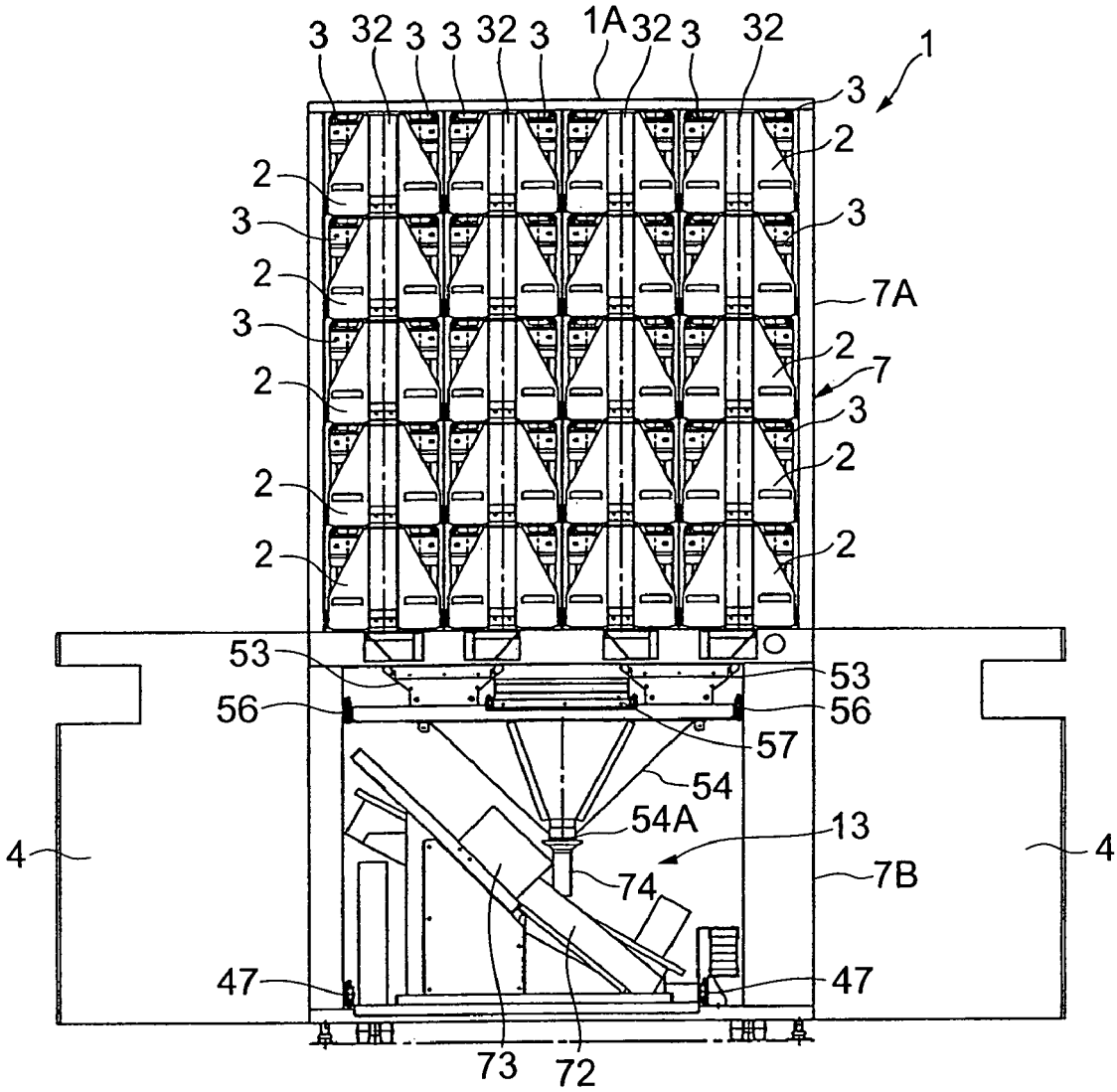
FIG. 2 is a front view of the medicine feeding device in a state in which a door panel of each shelf is removed, and a lower panel is opened.

Next, the preferred embodiment of the present invention will be described in detail with reference to the accompanying drawings.

A medicine feeding device 1 of the present invention is installed at a hospital or a dispensing pharmacy, and comprises an oblong rectangular main body 7 and a later-described personal computer for control. The main body 7 comprises upper and lower structures 7A and 7B to be separated from each other, and it is structured in a manner that the upper structure 7A is laminated to be connected on the lower structure 7B. In the upper structure 7A, a case storage section 8 opened on front and upper-and-lower sides is constituted to store a later-described tablet case 3. A top surface of the case storage section 8 is covered with a detachable top plate 1A.

Front and upper surfaces of the lower structure 7B are opened, and the upper surface is communicated with the upper structure 7A. A wrapping machine 13 or the like is installed as a later-described filling device in the lower structure 7B, and an opening of the front surface is covered with biparting lower panels 4, 4 to be freely opened/closed.

Illustratively shown are 4 left and right rows of, and 5 up and down stages of shelves 2 (totally 20) installed in the case storage section 8 of the upper structure 7A. A door panel 6 is attached to a front end of each shelf 2, and the door panels 6 cover the front opening of the upper structure 7A (case storage section 8) in a state in which all the shelves 2 are stored in the case storage section 8. A passage 9 opened up-and-down is formed back and forth on a center of the shelf. On both left and right sides of the passage 9, illustratively shown are 8 driving bases (totally 16) of a tablet case 3 attached back and forth in parallel.

The tablet case 3 comprises the driving bases and a detachable container connected thereon. A drum motor and an optical medicine detector sensor are attached in the driving base of the tablet case 3, and a chute is formed. This discharge chute is communicated to be opened in the passage 9. In FIG. 1, a reference numeral 111 denotes a control panel.

On the other hand, the container of the tablet case 3 is opened to the upper surface, and this opening is covered with an openable cap. A discharge drum is attached to a bottom of the container, and a plurality of longitudinal grooves are formed at predetermined intervals around a side face of the discharge drum. The discharge drum is rotated by the drum motor, and medicines are discharged one by one form the discharge chute to the passage 9. This medicine discharging is detected by the medicine detection sensor to be counted.

The shelf 2 to each of which the plurality of tablet cases 3 is stored in the case storage section 8 so as to be freely pulled out. A harness 28 is disposed in a rear end of the shelf 2 to electrify the drum motor of the tablet cases 3 and to transmit an output from the medicine detection sensor.

In a state in which the plurality of shelves 2 are stored in the case storage section 8, the passages 9 of the shelves 2, which are located up and down, correspond to each other to constitute a series of chutes 32 that are communicated up and down. Thus, according to the embodiment as illustratively shown, 4 left and right rows of chutes 32 are constituted up and down in the case storage section 8.

Figure 3:
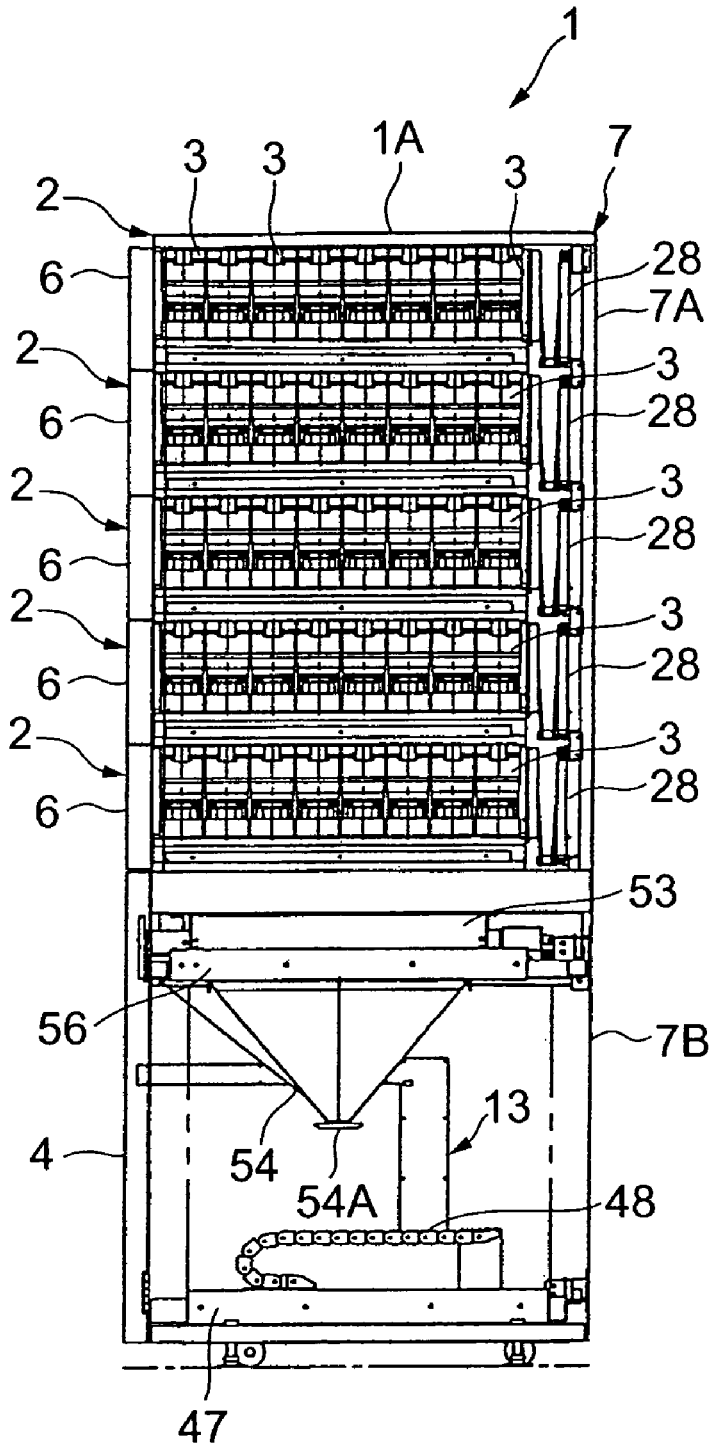
FIG. 3 is a longitudinal side view of the medicine feeding device of FIG. 1.

On the other hand, the wrapping machine 13 (filling device is stored in the bottom side of the lower structure 7B of the main body 7 as described above. A structure of the wrapping machine 13 will be described later. The wrapping machine 13 is detachably fixed by screws to drawing rails 47, 47 attached to left and right sides of the bottom of the lower structure 7B as shown in FIG. 3. Accordingly, the wrapping machine 13 is freely pulled out to the front from the lower structure 7B in open states of the lower panels 4, 4, and detachably fixed to the drawing rails 47, 47 in a pulled-out state. A reference numeral 48 is a wrapping machine harness detachably connected by a connector between the wrapping machine 13 and the lower structure 7B, and has a length to permit a sufficient pulling-out amount of the wrapping machine 13.

Two opening/closing plates 53, 53 are disposed side by side in the upper side of the lower structure 7B. The opening/closing plates 53, 53 correspond to the lower sides of the chutes 32 located above. The opening/closing plate 53 of the right side corresponds to the chutes 32, 32 of the right end and the left side, while the opening/closing plate 53 of the left side corresponds to the chutes 32, 32 of the left end and the right side. The opening/closing plate 53 serves to temporarily receive a medicine dropped from each chute 32 to a later-described hopper 54.

The hopper 54 is disposed in the lower structure 7B corresponding to the lower sides of the opening/closing plates 53, 53. The hopper 54 is formed in a rectangular filter shape which is widely opened in an upper surface and narrowed toward the bottom end. The hopper 54 receives medicines dropped from the chutes 32, and passed through the opening/closing plates 53, 53, and discharges the medicines from a bottom end opening 54A.

The upper end left and right sides of the hopper 54 are detachably fixed by screws to drawing rails 56, 56 attached to the upper left and right sides of the lower structure 7B. The opening/closing plates 53, 53 are positioned on the drawing rails 56, 56 to be detachably fixed thereto by screws. Thus, the hopper 54 and the opening/closing plate 53, 53 are simultaneously pulled out freely to the front from the lower structure 7B in the opened states of the lower panels 4, and detachably attached to the drawing rails 56, 56 in the pulled-out state. A not-shown detachable harness for the opening/closing plate 53 is also disposed. This harness has a length to permit a sufficient pulling-out amount of the opening/closing plate 53.

By the above structure, in the case of maintenance such as replacement of the tablet case 3, cleaning of the chutes 32 constituted of the passages 9, and the hopper 54, and component replacement of the wrapping machine 13, these portions are pulled out from the upper structure 7A or the lower structure 7B of the main body 7 to carry out detaching work.

Accordingly, it is possible to realize smooth medicine filling by greatly improving maintenance workability of the medicine feeding device 1. Especially, since the plurality of tablet cases 3 are simultaneously pulled out of the upper structure 7A together with the shelves 2, and the container is detachably attached, replacing workability of the container of the tablet case can be greatly improved.

Additionally, since the opening/closing plates 53, 53 are pulled out of the lower structure 7B, and detachably attached, it is possible to improve maintenance workability of opening/closing plates 53, 53 which temporarily receive the medicine to the hopper 54. Especially, since the opening/closing plates 53, 53 and the hopper 54 are attached so as to be simultaneously pulled out of the lower structure 7B, it is possible to greatly improve workability in the case of maintenance of the opening/closing plate 53 and the hopper 54.

An additional medicine feeder (UTC) 57 is attached to an upper center of the lower structure 7B to be positioned between the opening/closing plates 53, 53. In this case, the additional medicine feeder 57 is pulled out to the front itself without being covered with the lower panels 4, 4, and detachably attached (FIG. 1). This additional medicine feeder 57 optionally feeds additional medicines, and it is communicated with the hopper 54.

Next, a constitution of the wrapping machine 13 will be described by referring to FIG. 4. A reference numeral 71 denotes a roll formed by winding wrapping paper 72 (constituting a container) to be deposited by heat, 73 a printer, 74 a nozzle attached to the bottom end opening 54A of the hopper 54, 76 a heat seal head made of silicon rubber, 77 a roller for conveying the wrapping paper 72 pulled out form the roll 71, 79 a cutter for cutting the wrapping paper 72, and 81 a conveyor for conveying the divisionally cut wrapping paper 72 to a take-out port 82 disposed in the lower panel 4, which are sequentially disposed along the conveying path of the wrapping paper 72. A reference numeral 83 denotes a motor for operating the heat seal head 76, 78 a motor for driving the roller 77, and 84 a motor for the conveyor 81.

The wrapping paper 72 wound in the state of the roll 71 is roughly V-shaped in section in which an upper surface is opened, and a lower end is folded (half-folding). The wrapping paper is temporarily pulled out from the roll 71 obliquely right upward by the roller 77 or the like, then pulled out obliquely right downward, and printing is carried out on the surface thereof by the printer 73 as described later. Then, a medicine discharged from the nozzle 74 is supplied into the wrapping paper 72, and the wrapping paper 72 is divided for each wrapping by heat deposition of the heat seal head 76. The divided wrapping paper 72 is then cut by the cutter 79, and conveyed on the conveyor 81 to the left upper take-out port 82.

Figure 5:
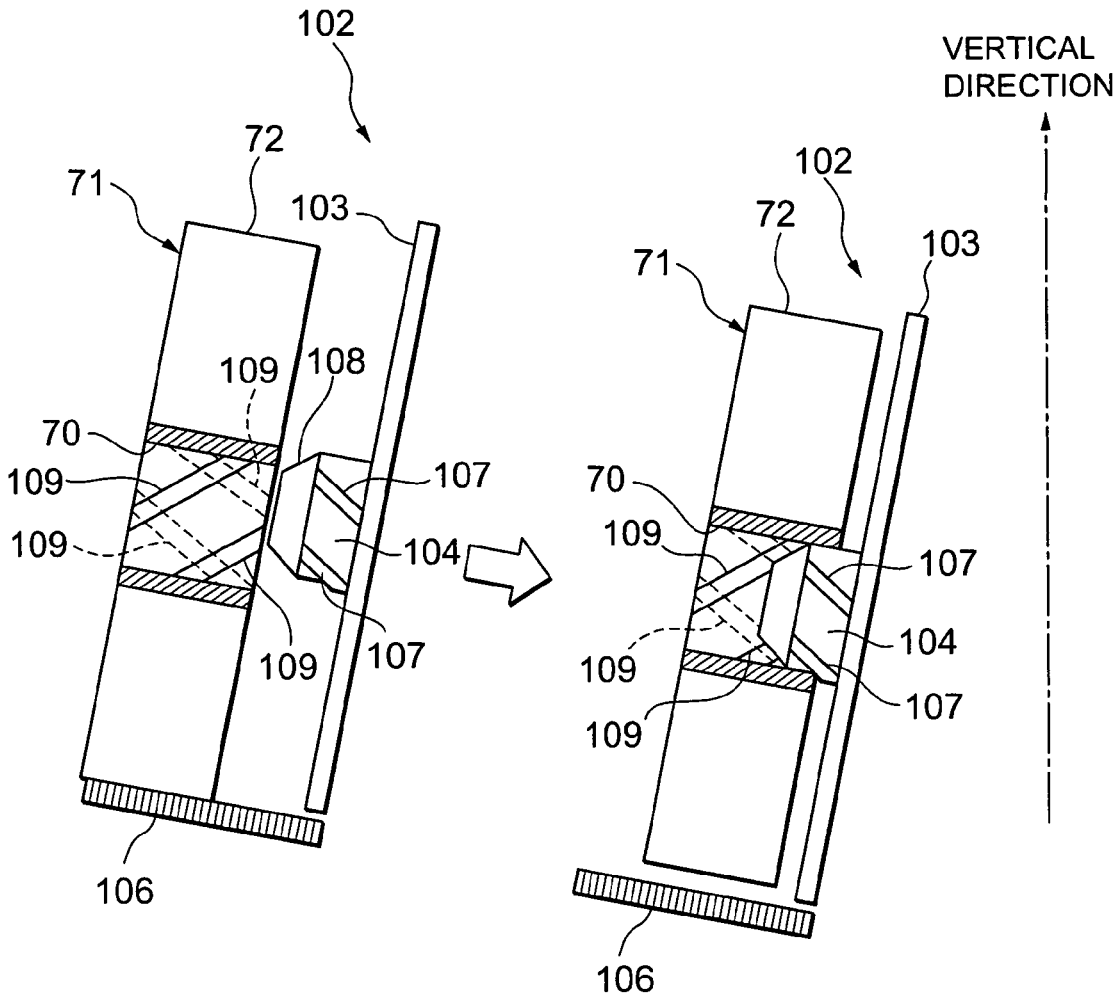
FIG. 5 is a view illustrating an operation of attaching a roll of wrapping paper to a wrapping paper delivery mechanism of the medicine feeding device of FIG. 1.
Figure 6:
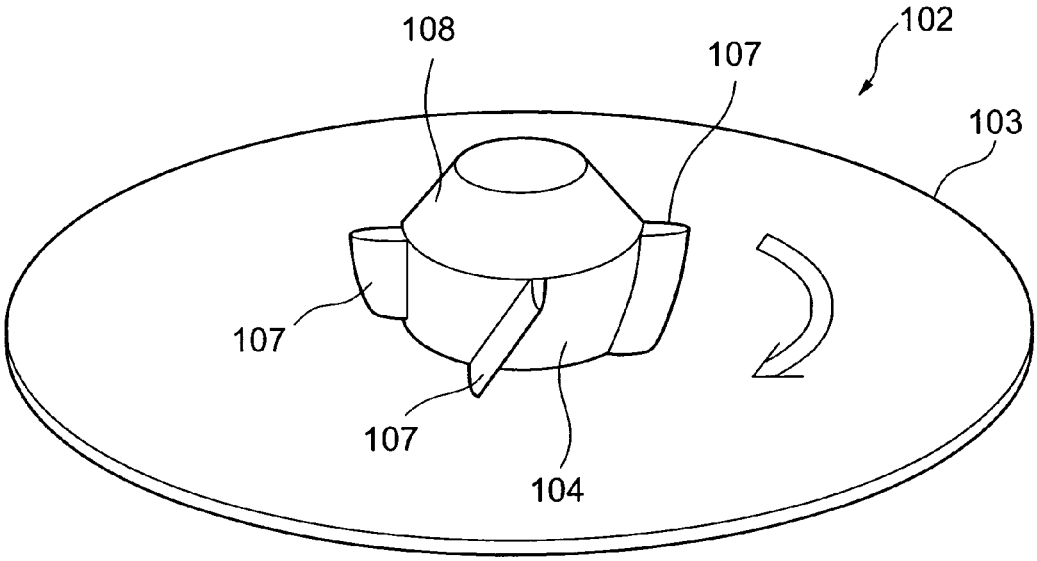
FIG. 6 is a perspective view of a base plate of the wrapping paper delivery mechanism of FIG. 5.

In this case, as shown in FIG. 5, the wrapping paper 72 is wound in the state of the roll 71 around a cylindrical shaft tube 70 (made of synthetic resin). The roll 71 is detachably attached to a wrapping paper delivery mechanism 102 disposed below an attaching plate 101 inclined at an angle of about 20° obliquely right upward when seen from the front. As shown in FIG. 6, the wrapping paper delivery mechanism 102 comprises a disk base plate 103, an engaging shaft 104 projected from a center of the base plate 103, a guide plate 106 correspondingly disposed below the base plate 103, and a not-shown brake mechanism abutting on the bottom side of the base plate 103.

The engaging shaft 104 is made of a metal or a synthetic resin, and a plurality of engaging projections 107 are formed in a side face thereof as shown in FIG. 6. Each engaging projection 107 is inclined to intersect an axial direction of the engaging shaft 104 (the engaging shaft 104 is projected obliquely right upward from the base plate 103 in FIG. 4, and projected obliquely left upward in FIG. 5) at a predetermined angle. This inclination is set so that the projection can be extended from the tip of the engaging shaft 104 toward the base end 103, and in a rotational direction (indicated by an arrow in FIG. 6) of the engaging shaft 104 and the base plate 103. The engaging shaft 104 is formed in a predetermined tapered shape so that its tip can be tapered, and a tapered portion 108 is formed therein.

On the other hand, an inner diameter of the shaft tube 70 of the roll 71 of the wound wrapping paper 72 is set to enable adhesion and engagement with the side face of the engaging shaft 104. A plurality of engaging grooves 107 . . . are formed on the inner surface of the shaft tube 70, each of which has a depth to be engaged with the engaging projection 107 of the engaging shaft 104, and which are inclined in the same direction (broken line in FIG. 5 is a virtual line indicating the engaging groove 109 of the front side).

On the other hand, as shown in FIG. 5, the guide plate 106 is arranged slightly apart from the base plate 103, and at least corresponds to the lower side (obliquely left lower side in FIG. 5) of the engaging shaft 104. When the roll 71 of the wrapping paper 72 is mounted on the wrapping paper delivery mechanism 102, as shown in the upper side of FIG. 5, first, the roll 71 is mounted on the guide plate 106 to be positioned with the engaging shaft 104 of the shaft tube 70. In this case, the guide plate 106 may be bent so that a portion corresponding to the engaging shaft 104 can be lowest. This constitution further facilitates the positioning.

When the roll 71 is moved toward the base plate 103 in this state, as shown in the upper side of FIG. 5, an inner edge of the upper side of the bottom surface of the shaft tube 70 abuts on the tapered portion 108 of the engaging shaft 104 (a positional relation between the base plate 103 and the guide plate 106 is properly set in accordance with a dimension of the roll 71 as described above). When the roll 71 of the wrapping paper 72 is further moved toward the base plate 103, the shaft tube 70 is guided by the tapered portion 109, separated from the guide plate 106 to be raised, and its axial center coincides with that of the engaging shaft 104. Thus, by disposing the tapered portion 108 and the guide plate 106, the positioning of the roll 71 is greatly facilitated.

Then, when the roll 71 is slightly rotated in an arrow direction of FIG. 6, the engaging groove 109 on the inner surface of the shaft tube 70 coincides with the engaging projection 107 of the engaging shaft 104 before long. Thus, by rotating and screwing in the roll 70 in the arrow direction of FIG. 6, the engaging projection 107 enters the engaging groove 109 to be detachably engaged (state of the lower side of FIG. 5). Lastly, the roll 71 is mounted to be fixed on the upper surface of the base plate 103.

The engaging projection 107 of the engaging shaft 104 is extended in the rotational direction of the base plate 103 and the engaging shaft 104 so as to be inclined toward the base plate 103 as described above. Accordingly, when the wrapping paper 72 delivered, as described above, a force on the shaft tube 70 and the engaging shaft 104 is applied in a direction for further fastening engagement between the engaging projection 107 and the engaging groove 109. Thus, falling-off of the roll 71 can be prevented even in the case of a small projecting dimension (according to the embodiment, a height dimension to the bottom end of the tapered portion 109 is 10 mm) of the engaging shaft 104.

According to the embodiment, the attaching plate 101 is inclined to project the engaging shaft 104 obliquely upward at 45°. However, the invention is not limited to this. A structure may be employed in which the engaging shaft 104 is projected obliquely upward at a smaller angle including a horizontal direction (in this case, the base plate 103 is set in a vertical direction).

Figure 4:
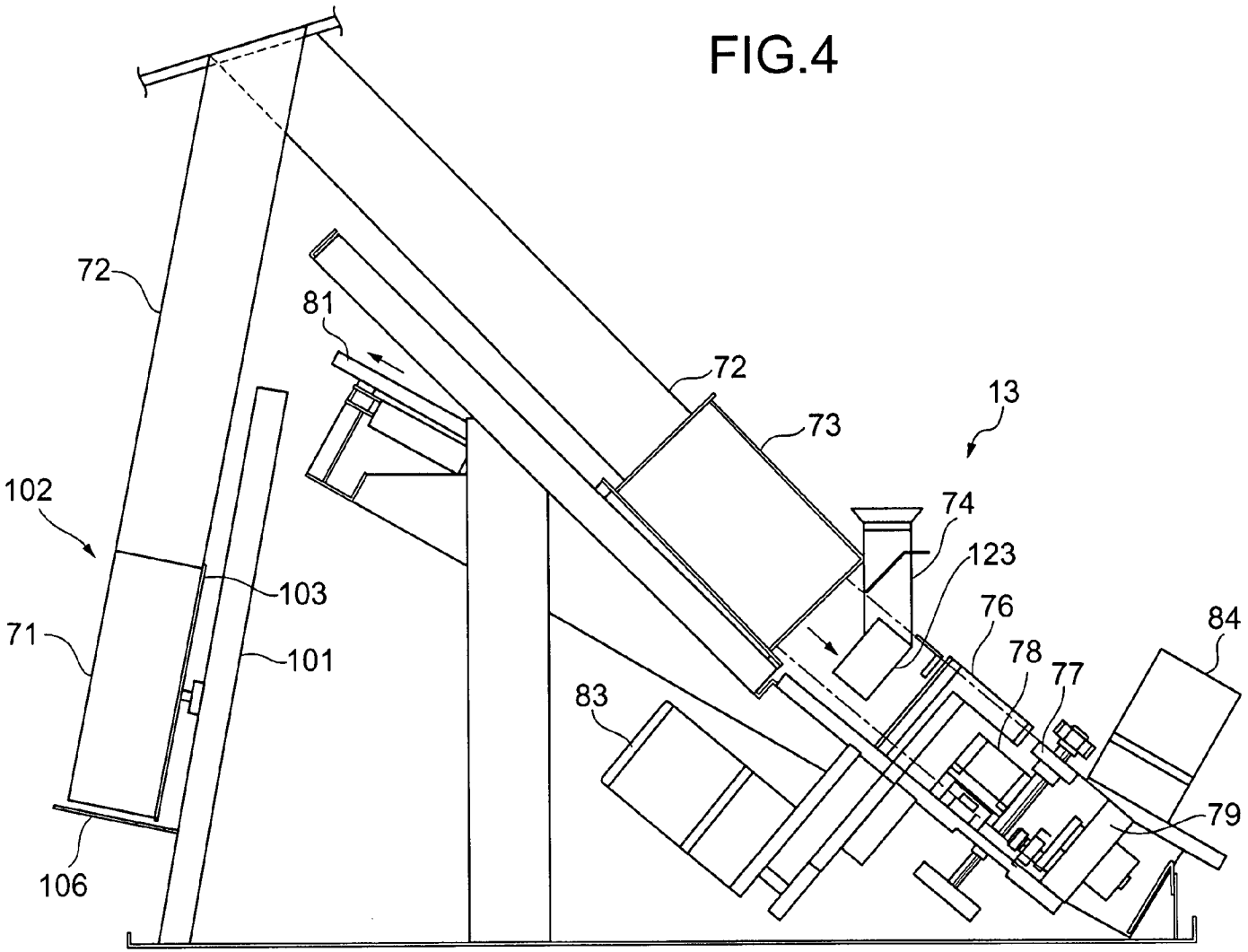
FIG. 4 is a front view of a wrapping machine of the medicine feeding device of FIG. 1.
Figure 7:
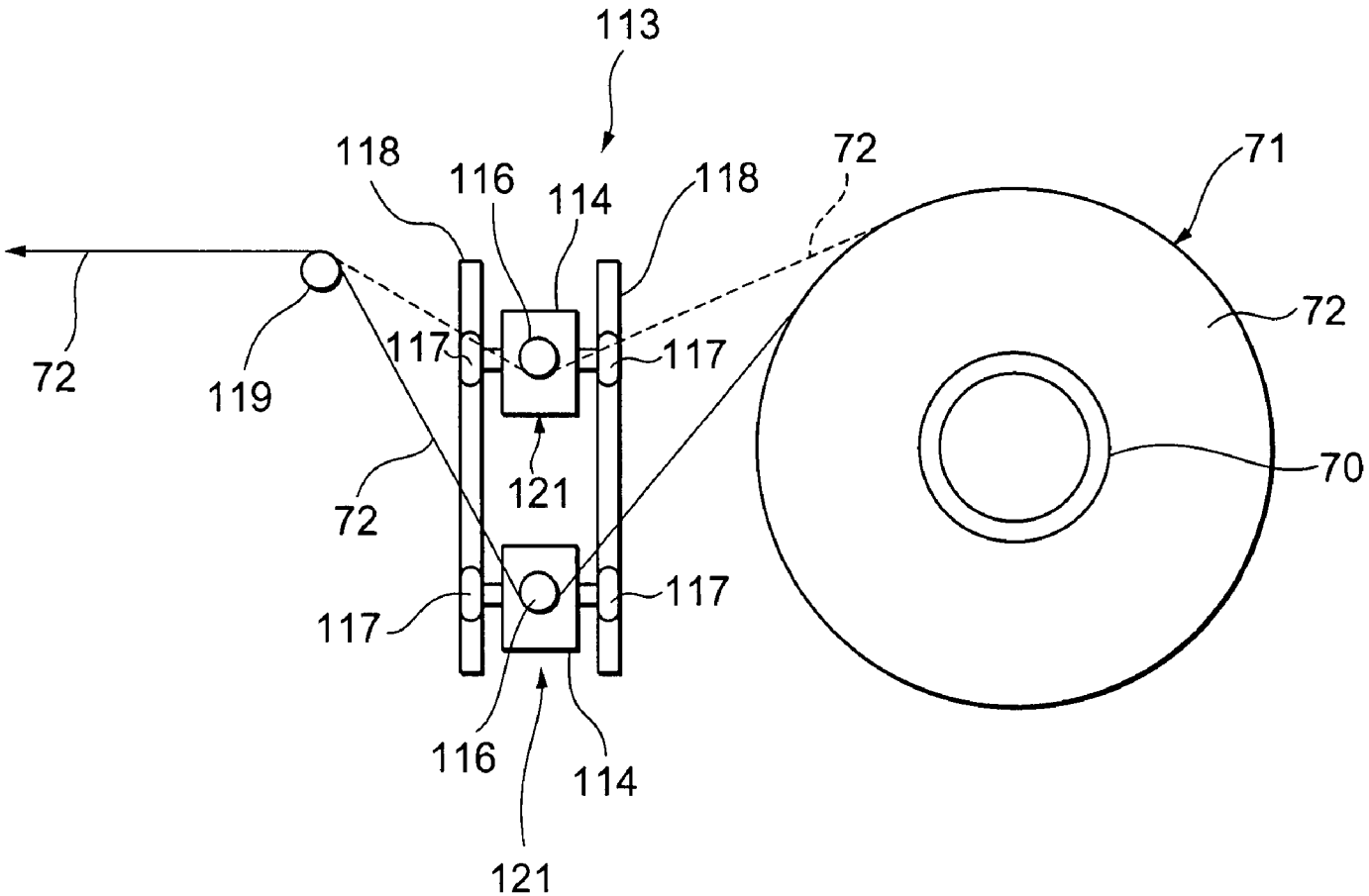
FIG. 7 is a front view of the roll of the wrapping paper and a mechanism for applying tension to the wrapping paper in the medicine feeding device of FIG. 1.

FIG. 7 is a front view of the roll 71 when seen from obliquely left upper side of FIG. 4. A tension application mechanism 113 is disposed on the attaching plate 101 in the path between the roll 71 and the printer 73. This tension application mechanism 113 comprises a metal base portion 114, an operation section 121 which is constituted of a rod 116 made of a metal round rod (circular in section) having a dimension longer than a width of the wrapping paper 72 and which projects from the base portion 114, a pair of rollers 117, 117 disposed in both sides to be projected from the base portion 114, a pair of rails 118 with which the rollers 117, 117 are engaged so as to slide, and a tension pin 119.

The operation section 121 has predetermined weight itself. The rails 118, 118 are disposed in a direction in which the attaching plate 101 is inclined, and extended from right to left (up-and-down direction, it may be in a vertical direction) in FIG. 4. Thus, by the sliding of the rollers 117, 117, the operation section 121 which includes the rod 116 is moved up and down along the rails 118, 118 by their own weight. The tension pin 119 is positioned on an upper side opposite the roll 71 in a manner of sandwiching the rails 118, 118 and, as described later, the rod 116 is positioned roughly symmetrically left and right in a state of depressing the wrapping paper 71 (FIG. 7). Thus, roughly uniform force is applied on the left and right wrapping paper 72 of the rod 116.

According to the aforementioned constitution, the wrapping paper 72 pulled out of the roll 71 is passed below the rod 116 of the tension application mechanism 113, and pulled from the upper side of the tension pin 119 to the printer 73. Thus, since a falling force of the operation section 121 by its own weight becomes a force by which the rod 116 depresses the wrapping paper 72, tension is applied to the wrapping paper 72.

When the wrapping paper 72 is pulled out of the roll 71 by the roller 77 or the like, by its tensile force, the operation section 121 is raised by the wrapping paper 72 as indicated by a broken line of FIG. 7. When the tensile force is weakened, the operation section 121 is lowered again (state indicated by a solid line in FIG. 7). Thus, the tension is applied to the wrapping paper 72 to prevent occurrence of wrinkles. However, since the operation section 121 of the tension application mechanism 113 is moved up and down by its own weight to apply the tension to the pulled-out wrapping paper 72 as described above, the tension applied to the wrapping paper 72 is not affected by a moving position of the operation section 121.

Therefore, constant tension can be always applied uniformly to the continuously pulled-out wrapping paper 72 wound in the roll state, and it is possible to effectively eliminate occurrence of both wrinkles and cutting due to excessive tension. Especially, since the tension application mechanism 113 comprises the operation section 121 for depressing the wrapping paper, the rollers 117, 117 disposed in the operation section 121, and the vertical rails 118, 118 with which the rollers 117, 117 are engaged to slide, the operation section 121 and the rollers 117, 117 are smoothly moved along the rails 118, 118 by their own weight to apply always constant tension to the wrapping paper 72.

Figure 8:
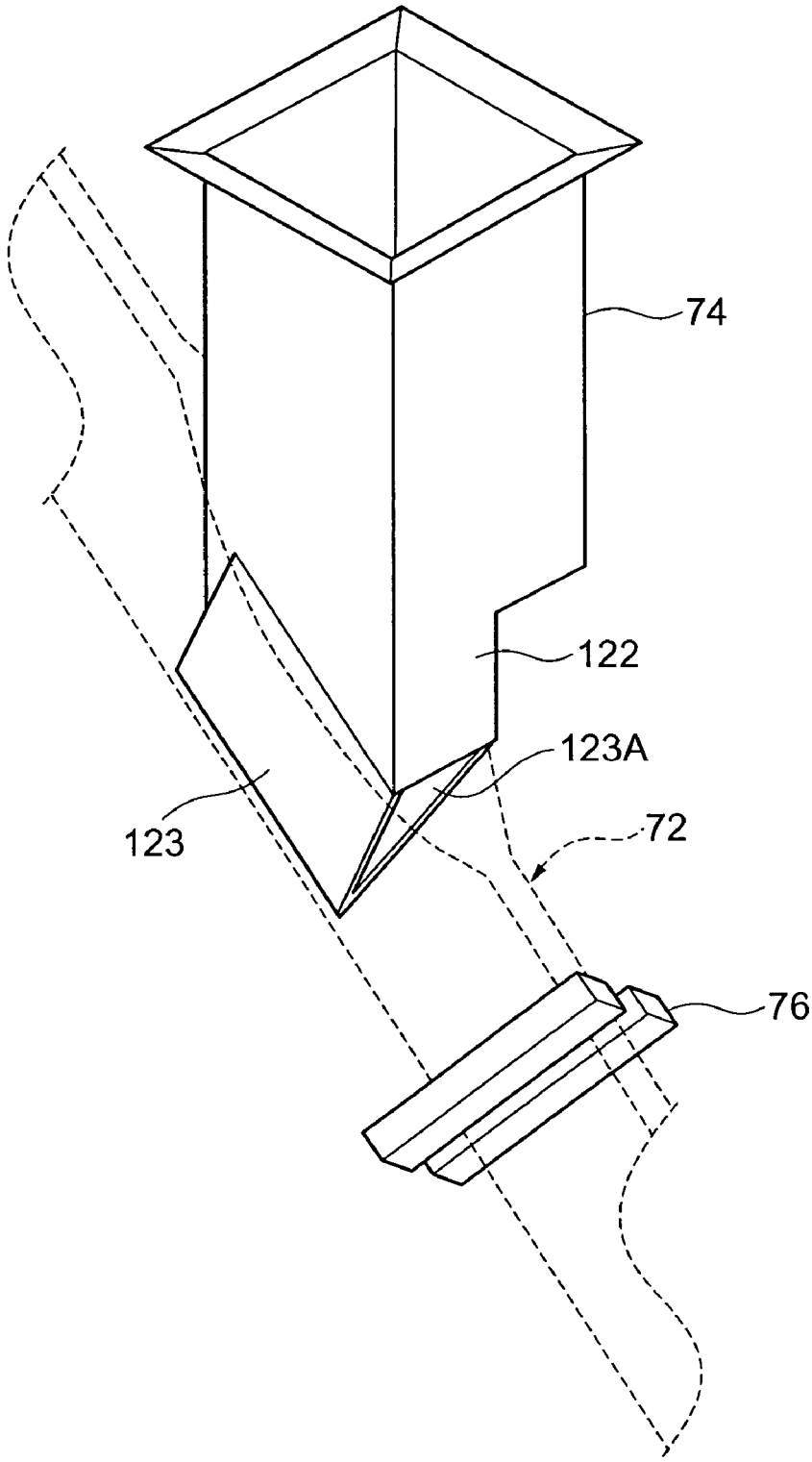
FIG. 8 is a perspective view of a nozzle of the medicine feeding device of FIG. 1.

The nozzle 74 is disposed roughly vertically as shown in FIG. 8. This nozzle 74 is formed in a rectangular cylinder in which upper and lower sides are opened. An outlet portion of its tip (lower side) is formed as a narrow width portion 122 in which a back-and-forth width toward the front side is narrower than that of an inlet, and the lower end of the narrow width portion 122 is opened as a medicine dropping passage outlet in the nozzle 74 (according to the embodiment, a depth inner dimension of the upper medicine dropping passage in the nozzle 74 is 30 mm, and the narrow width portion 122 is 18 mm). A normally used depth (width) dimension of the wrapping paper 72 is 74 mm and 43 mm. The narrow width portion 122 is formed so that the nozzle 74 can be inserted even into this shallow wrapping paper 72.

Figure 9:
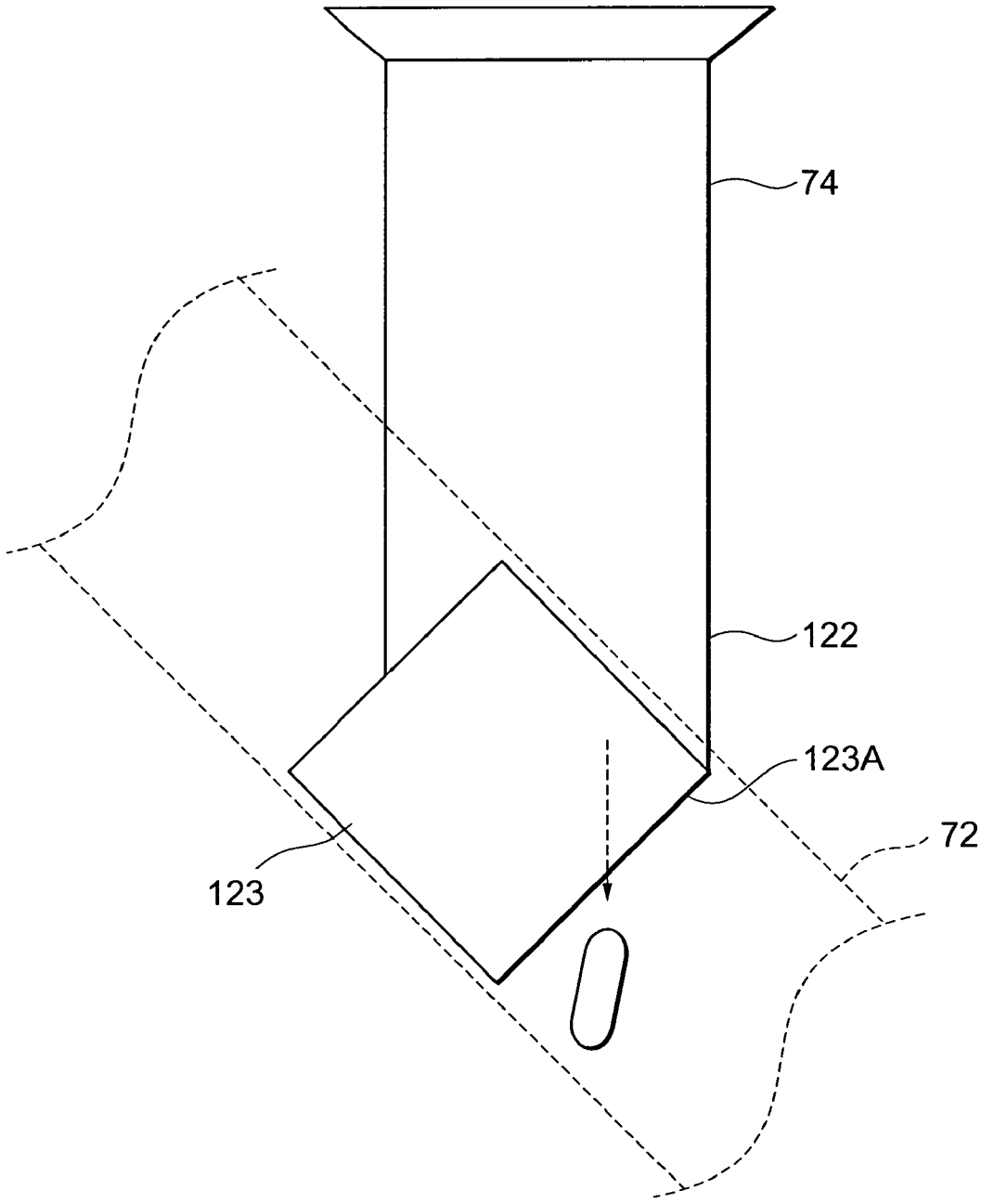
FIG. 9 is a front view of the nozzle of the medicine feeding device of FIG. 1.

A wrapping paper guide 123 is attached to the narrow width portion 122 from the outside. The wrapping paper guide 123 is formed in a roughly tapered V shape in section, and directed to be orthogonal to an advancing direction (45°-inclined direction from left to right) of the wrapping paper 72 (FIG. 9). The front and rear surfaces (left and right surfaces in FIG. 4) of the wrapping paper guide 123 in the advancing direction of the wrapping paper 72 are opened. Accordingly, the medicine dropped in the nozzle 74 can be passed from the opening surface of the front lower side (right lower side in FIG. 9, indicated by 123A on the front side in FIG. 8) of the wrapping paper guide 123 downward (indicated by a broken line arrow in FIG. 9).

The upper end opening of the nozzle 74 is set oppositely to the bottom end opening 54A of the hopper 54, and the nozzle 74 is inserted from the lower end of the wrapping paper guide 123 into the wrapping paper 72. In this case, since the wrapping paper guide 123 is V-shaped in section, it can be easily inserted from the upper opening side of the wrapping paper 72 folded as described above. In this case, if the nozzle 74 can be slid from the upper surface of the wrapping paper 72 to the far side, the replacing work of the wrapping paper 72 and the work of inserting the wrapping paper guide 123 into the wrapping paper 72 are further facilitated.

Because of the insertion of the nozzle 74 into the wrapping paper 72, the wrapping paper 72 is bulged left and right in the advancing direction by an amount equivalent to its back-and-forth dimension as indicated by a broken line in FIG. 8. However, since the tapered wrapping paper guide 123 is attached to be inserted into the wrapping paper 72, wrinkles or slackening on the wrapping paper 72 is prevented or limited to a minimum.

Thus, because of the insertion of the nozzle 74 into the wrapping paper 72, the medicine received by the hopper 54 enters the nozzle 74. Then, the medicine is passed through the medicine dropping passage formed inside and through the opening surface of the wrapping paper guide 123 to be fed into the wrapping paper 72 (FIG. 9). At this time, since the bottom of the wrapping paper 72 is bulged by the wrapping paper guide 123, inconvenience of slackening or wrinkles is prevented or suppressed even if a large amount of medicines is fed in.

Figure 10:
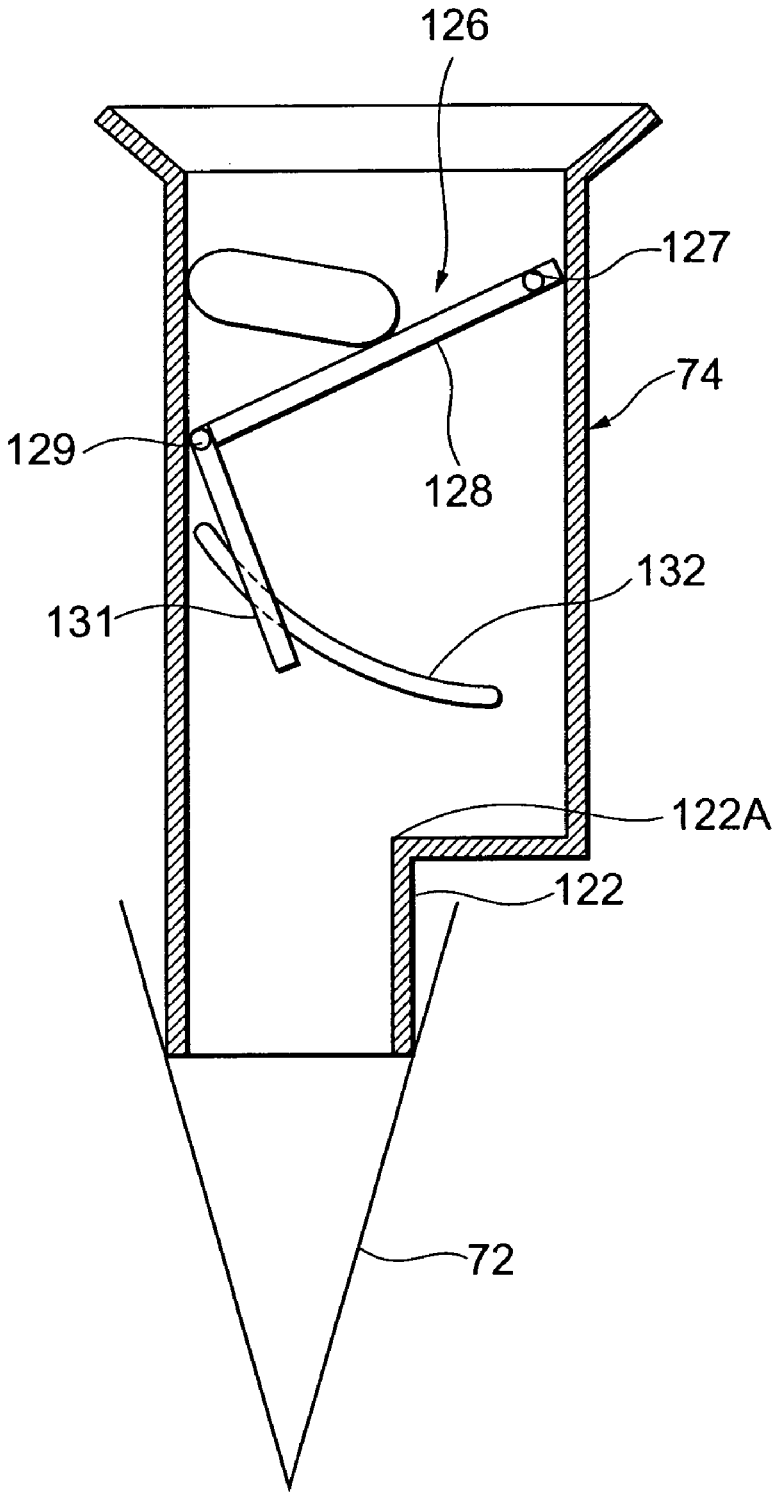
FIG. 10 is a longitudinal side view of the nozzle of the medicine feeding device of FIG. 1.

Further, a shutter 126 similar to that shown in FIG. 10 is disposed in the nozzle 74 (wrapping paper guide 123 is omitted in the drawing). This shutter 126 comprises a first shutter plate 128 which upper end is rotary-driven by a drive shaft 127 positioned in a deep upper side in the nozzle 74, and a second shutter plate 131 connected to a tip of the first shutter plate 128 by a rotary shaft 129 so as to be rotated and swung. A guide groove 132 is formed on the side wall of the nozzle 74, which coincides with a locus of the rotary shaft 129 rotated in conjunction with the rotation of the first shutter plate 128.

The rotary shaft 129 of its tip abuts on the inner wall of the nozzle 74 in a state in which the first shutter plate 128 of the shutter 126 is rotated upward as shown in FIG. 10. Accordingly, the first shutter plate 128 closes the medicine dropping passage in the nozzle 74 (FIG. 10). At this time, the second shutter plate 131 is suspended by its own weight in a state of being slightly inclined inside as shown in FIG. 10.

The shutter 126 temporarily receives the medicine discharged from the hopper 54 to the nozzle 74. During wrapping, when the shutter 126 is opened to drop the medicine, the first shutter plate 128 is rotated around the drive shaft 127 by not-shown driving means such as a solenoid or a motor counterclockwise in FIG. 10, and lastly set from the closed state of FIG. 1 to a drooped open state of FIG. 11. In this state, the medicine dropping passage in the nozzle 74 is opened. At this time, the tip of the second shutter plate 131 abuts on an upper end corner 122A (place in which the medicine dropping passage is narrowed) which becomes a starting point of the narrow width portion 122, and set in an inclined state in which it is rotated clockwise around the drive shaft 129. When closing, the first shutter plate 128 is rotated clockwise in each drawing by the driving means to return to the state of FIG. 10.

Figure 11:
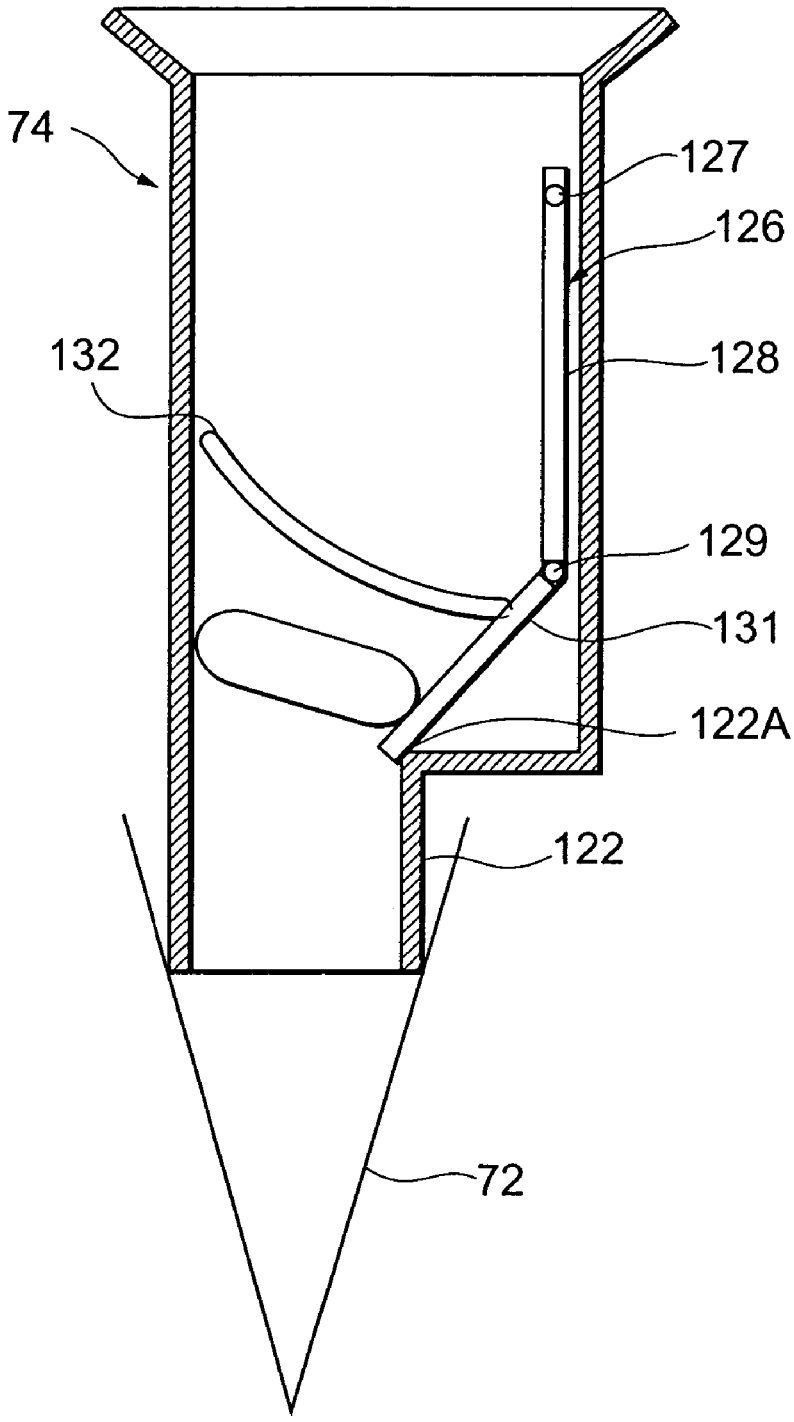
FIG. 11 is another longitudinal side view of the nozzle of the medicine feeding device of FIG. 1.

In this case, the medicine has a length of about 25 mm at the maximum. Thus, when the shutter 126 is opened to drop the medicine, if the medicine enters the narrow width portion 122 in a roughly horizontal state as shown in FIG. 11, clogging may occur because of the narrow width. At this time, since the second shutter plate 131 abuts on the corner 122A of the narrow width portion 122, and its lower end is located on the inlet of the narrow width portion 122 as shown in FIG. 11, the medicine which has caused the clogging is on the lower end of the second shutter plate 131.

Figure 12:
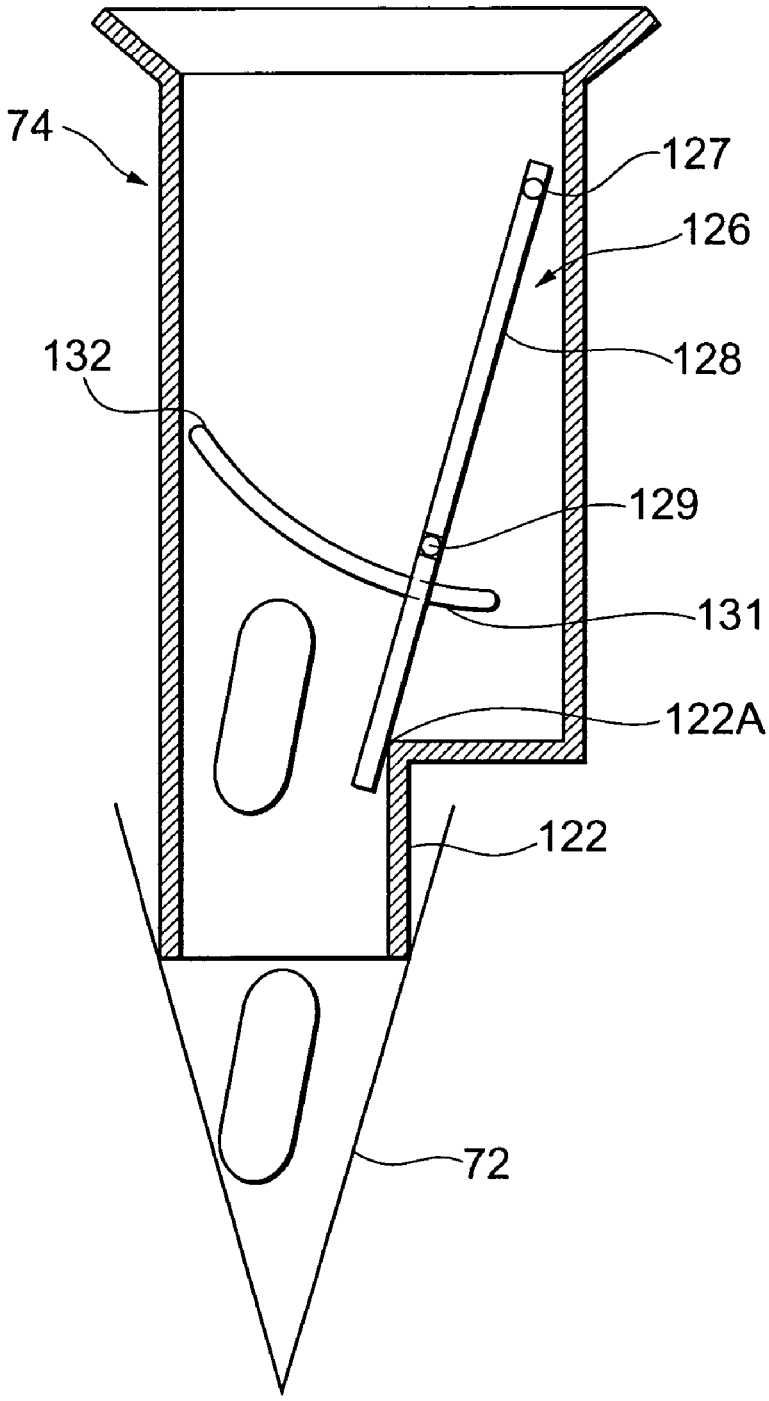
FIG. 12 is yet another longitudinal side view of the nozzle of the medicine feeding device of FIG. 1.

When the first shutter plate 128 is rotated in a closing direction from this state, as shown in FIG. 12, the second shutter plate 131 is swung counterclockwise as shown from the state of FIG. 11 during the rotation. Thus, an operation force is applied to lower the right end of the medicine in the state of FIG. 11 or the like. Accordingly, sine the medicine which has caused the clogging changes its posture, it is dropped in the narrow width portion 122 as shown in FIG. 12.

FIG. 11 shows the clogging state caused by one medicine. If several medicines cause clogging, the swinging of the second shutter plate 131 breaks postures thereof. In any case, clogging caused by many medicines can be eliminated by the structure of the shutter 126. However, if the clogging is not eliminated, a not-shown controller issues an alarm.

The controller opens/closes the shutter 126 by a timing in which such clogging by a medicine is difficult to occur by the driving means. The driving means is slowly operated to soften shocks to the medicine, and to prevent kicking-back. As this method, there are a method for gradually applying an input voltage to a solenoid, a method for disposing a predetermined mechanical damper, etc.

Figure 13:
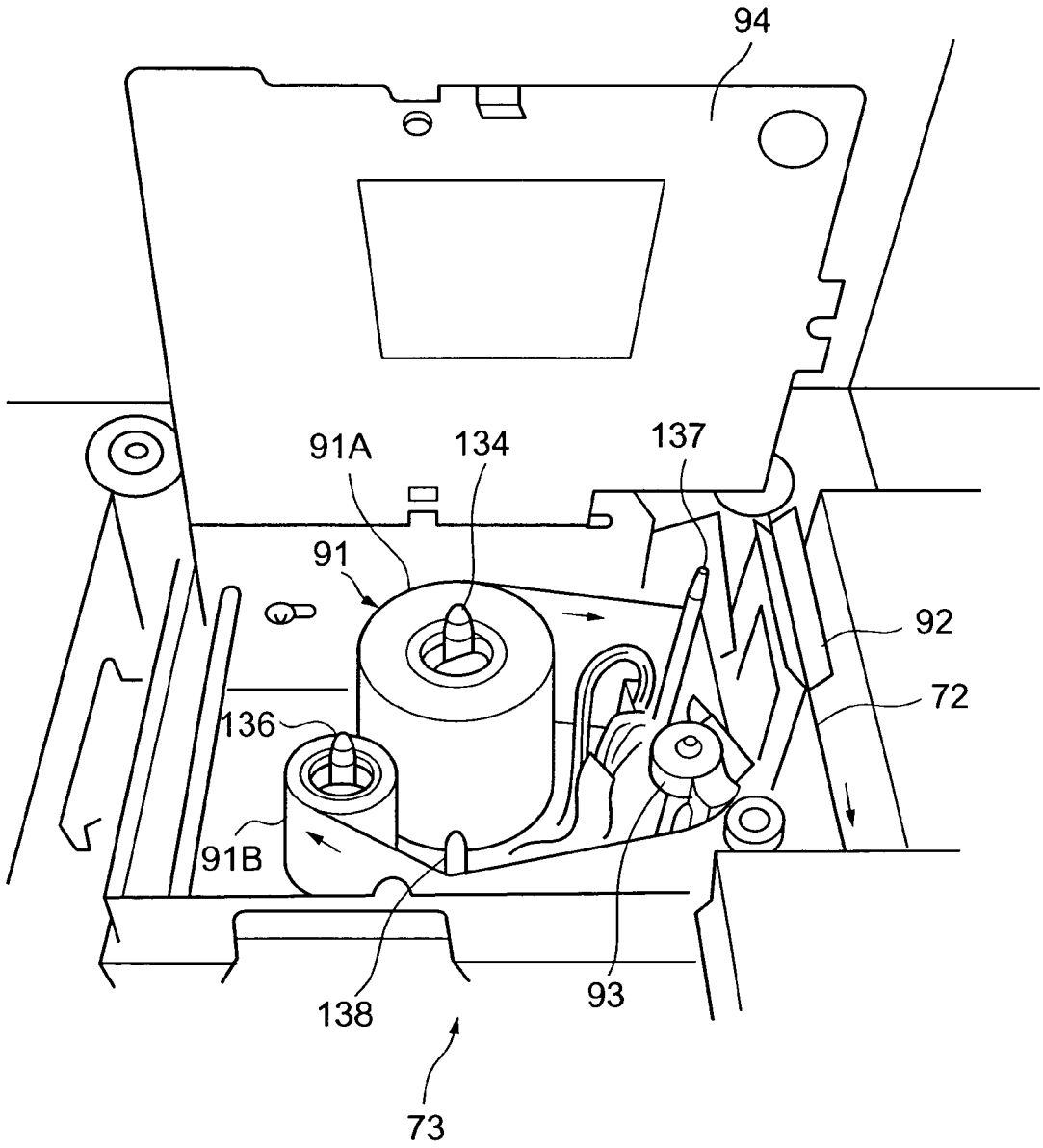
FIG. 13 is a perspective view of a printer of the medicine feeding device of FIG. 1.

Next, the printer 73 will be described. The printer 73 is a thermal transfer type which uses an ink ribbon. As shown in FIG. 13, the wrapping paper 72 is pressed to a color ink ribbon 91 by a pressing plate 92, and predetermined printing is carried out on the surface of the wrapping paper 72 by a thermal-transfer head 93.

A reference numeral 94 denotes an opening/closing cap of the printer 73. Advancing directions of the ink ribbon 91 and the wrapping paper 72 are indicated by arrows in the drawing. In the drawing, a reference numeral 134 denotes an ink ribbon feeding side bobbin of the printer 73, and 136 an ink ribbon winding side bobbin. Further, reference numerals 137, 138 denote guide pins for guiding the ink ribbon 91 to the thermal-transfer head 93. A feeding side 91A of the ink ribbon 91 (shaft tube of the ink ribbon feeding side) is attached to the feeding side bobbin 134, while a winding side 91B (shaft tube of the ink ribbon winding side) is attached to the winding side bobbin 136. Then, the ink ribbon is hooked sequentially on the guide pin 137, the thermal-transfer head 93 and the guide pin 138 (FIG. 13).

Figure 14:
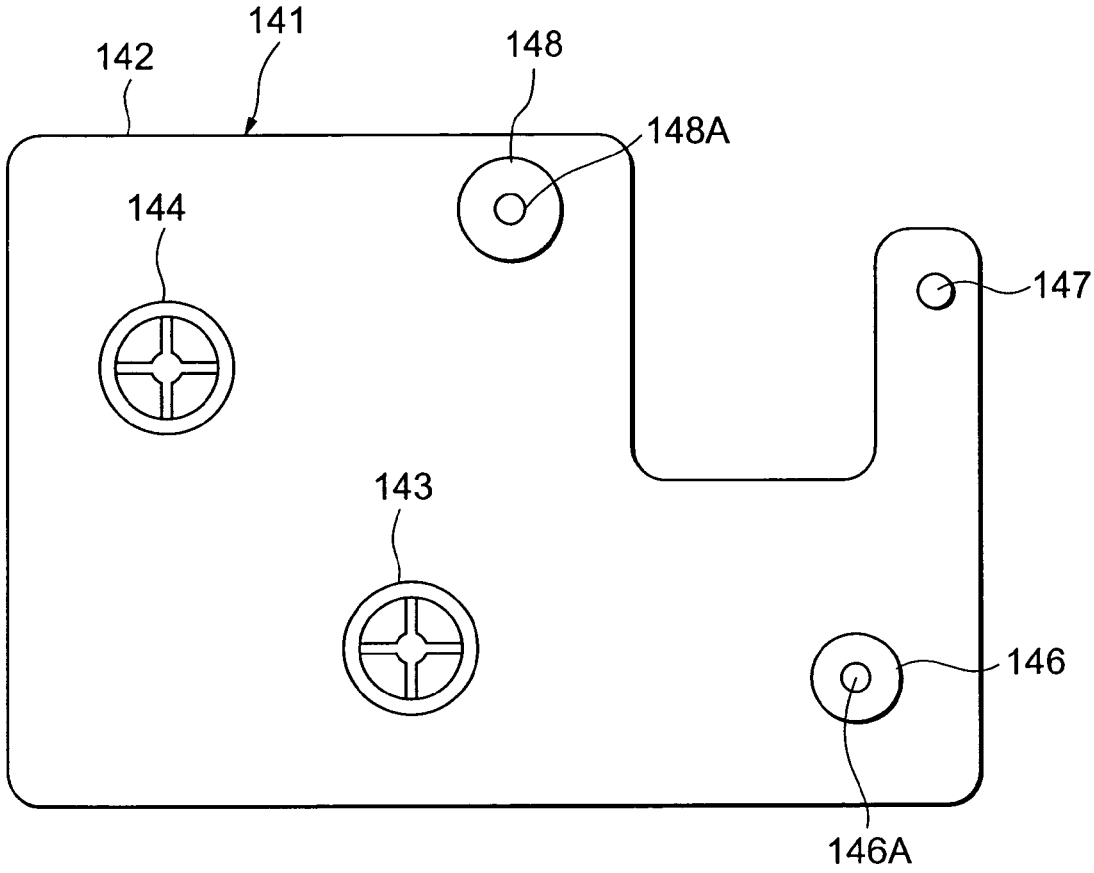
FIG. 14 is a front view of a fixture for mounting an ink ribbon on the printer of FIG. 13.

FIG. 14 is a front view of a fixture 141 for mounting the ink ribbon 91 on the printer 73. This fixture 141 comprises a flat plate fixture main body 142, a feeding side shaft 143, a winding side shaft 144 and guide shafts 146 to 148 which are disposed on one surface of the fixture main body 142, and a grip 149 disposed on the other surface of the fixture main body 142. In a state in which the fixture 141 is set oppositely to the printer 73, the feeding side shaft 143 is opposed to the feeding side bobbin 134 of the printer 73, and the winding side shaft 144 is opposed to the winding side bobbin 136 of the printer 73. The guide shaft 147 corresponds to a position outside the thermal-transfer head 93 of the printer 73, and the guide shafts 146, 148 correspond to the guide pins 137, 138 of the printer 73.

Figure 17:
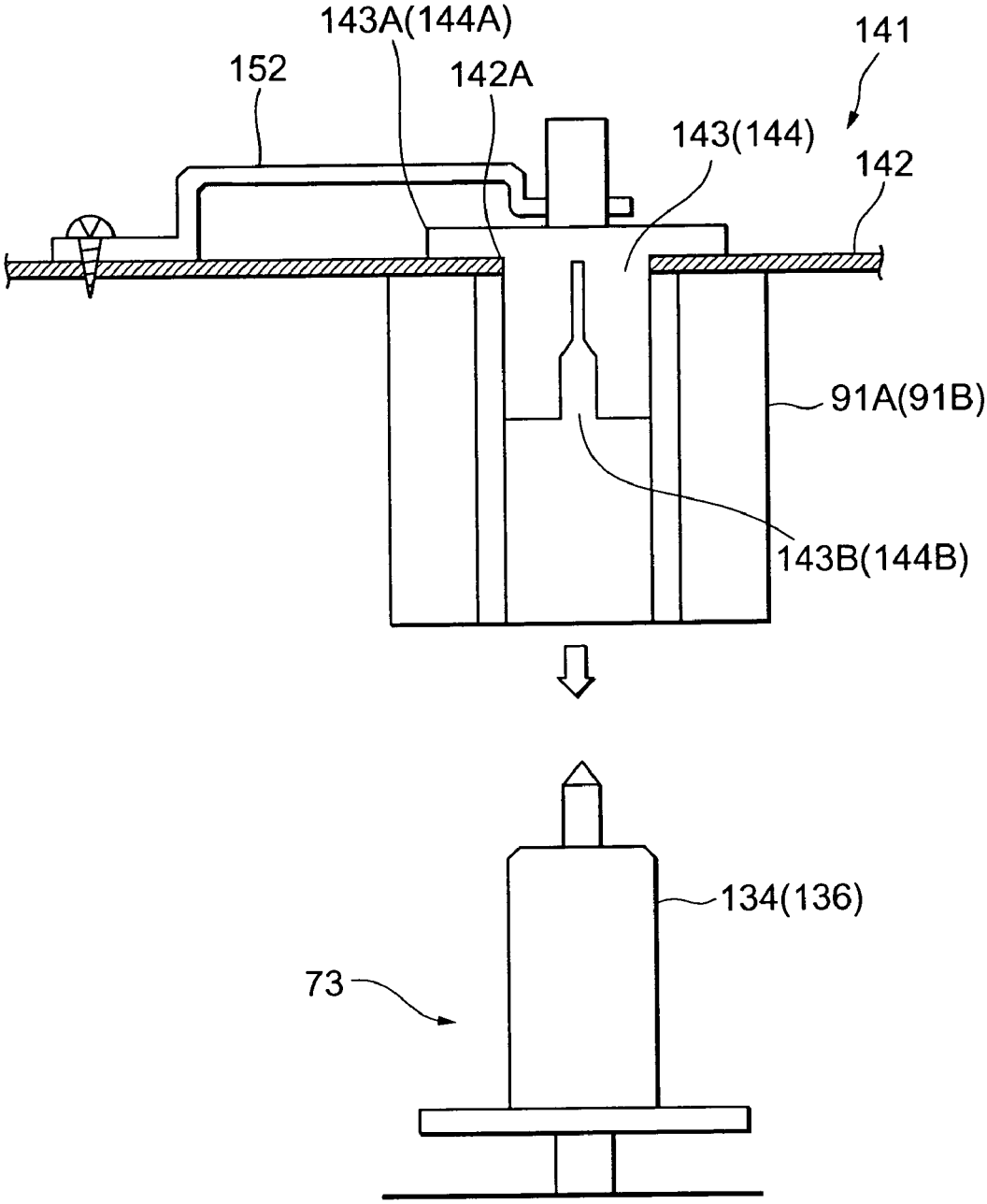
FIG. 17 is a sectional view of the fixture illustrating an operation of mounting the ink ribbon on the printer by the fixture of FIG. 14.

Holes 146A, 148A are formed in the centers of the guide shafts 146, 148, into which the guide pins 137, 138 can be inserted. As shown in FIG. 17, the feeding side shaft 143 and the winding side shaft 144 are held to freely move in a through-hole 142A formed in the fixture main body 142, and they have flanges 143A, 144A positioned on the other surface side of the fixture main body 142. Concave portions 143B, 144B are formed in the tips of the feeding side shaft 143 and the winding side shaft 144, which the feeding side bobbin 134 and the winding side bobbin 136 can enter.

The shafts 143, 144 are always pressed in a direction of being pushed out from the other surface side of the fixture main body 142 to one surface side by a leaf spring 152. This state is held by abutment of the flanges 143A, 144A on the other surface of the fixture main body 142.

Figure 15:
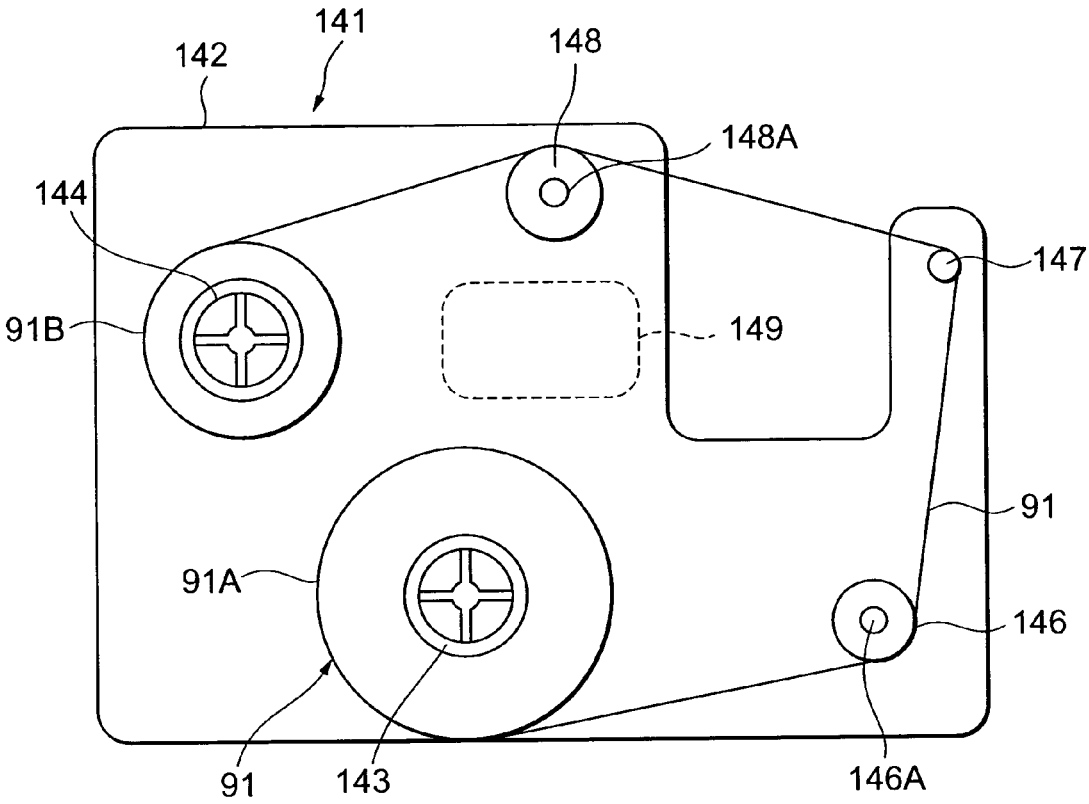
FIG. 15 is a front view of a state in which the ink ribbon is mounted on the fixture of FIG. 14.
Figure 16:
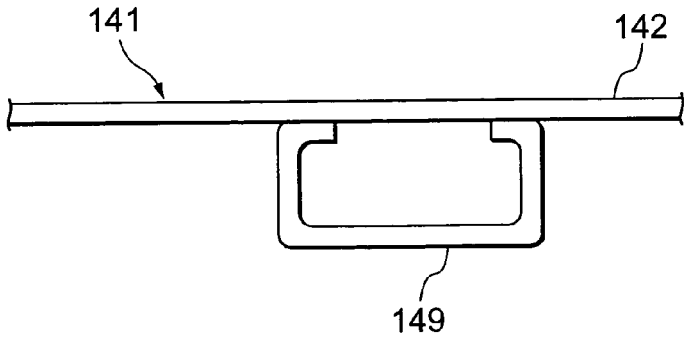
FIG. 16 is an enlarged view showing a gripping portion of the fixture of FIG. 14.

According to the above constitution, when the ink ribbon 91 is mounted on the printer 73, first, the feeding side 91A of the ink ribbon 91 (actually, the shaft tube of the ink ribbon feeding side) is detachably attached to the feeding side shaft 143 of the fixture 141, and the winding side 91B (similarly, the shaft tube of the winding side) of the ink ribbon 91 is detachably attached to the winding side shaft 144 of the fixture 141. The ink ribbon 91 is hooked on the outside of the guide shafts 146 to 148 (FIG. 15). In this state, each of the shafts 143, 144 enters roughly half of the width dimension of the ink ribbon 91.

After the attaching of the ink ribbon 91 to the fixture 141, the grip 149 is held to oppose the fixture 141 to the printer 73, and the feeding side 91A of the ink ribbon 91 is brought close to the feeding side bobbin 134, and the winding side 91B is brought close to the winding side bobbin 136 (indicated by arrows in FIG. 17). Then, when the feeding side bobbin 134 is inserted into the feeding side 91A of the ink ribbon 91 (similarly, the shaft tube of the feeding side) and the winding side bobbin 136 is inserted into the winding side 91B (similarly, the shaft tube of the winding side), the bobbins 134, 136 abuts on the shafts 143, 144 of the fixture 141 before long, and the tips of the bobbins 134, 136 enter the concave portions 143B, 144B.

Figure 18:
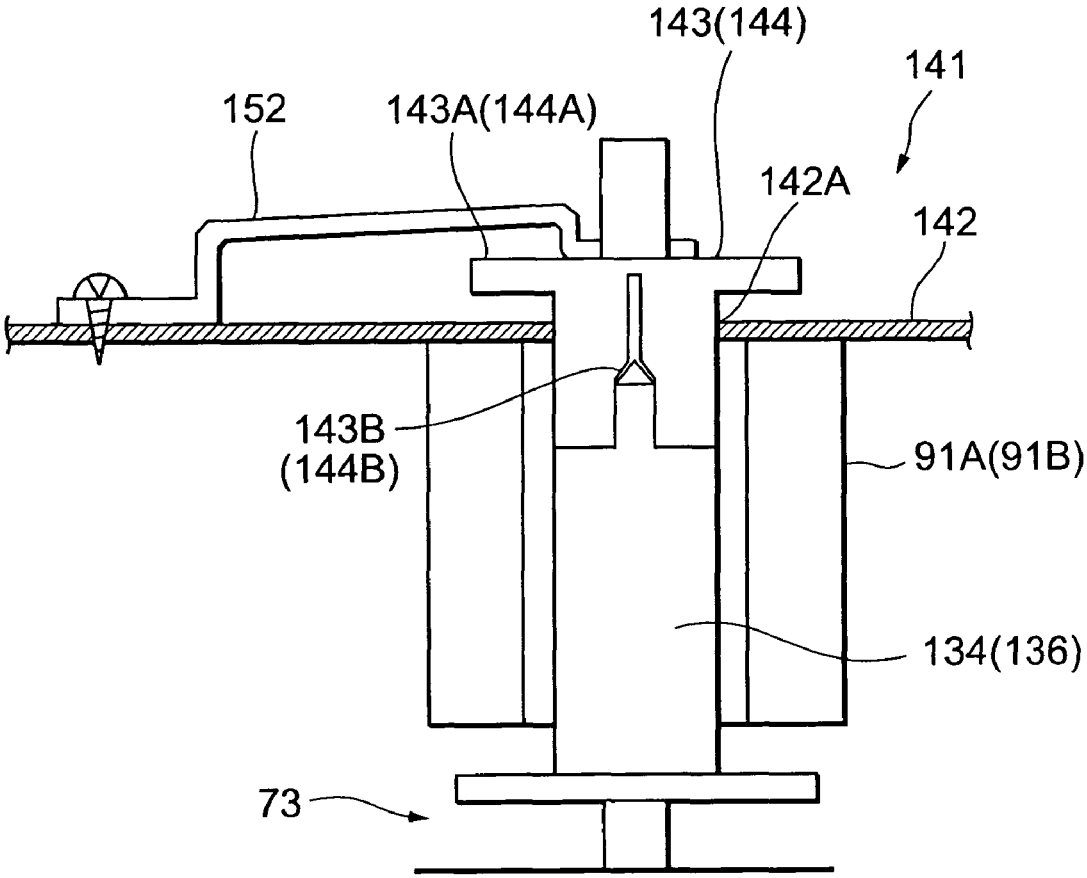
FIG. 18 is similarly a sectional view of the fixture illustrating the operation of mounting the ink ribbon on the printer by the fixture of FIG. 14.

In this state, by further pressing the fixture 141 to the printer 73 side, the shafts 143, 144 are pushed out to the other surface side of the fixture 141 against a pressing force of the leaf spring 152 (FIG. 18), and the shafts 143, 144 are pulled out of the feeding side 91A and the winding side 91B of the ink ribbon 91 before long. The guide pins 137, 138 of the printer 73 are detachably inserted into the holes 146A and 148A of the guide shafts 146 and 148, and the guide shaft 147 is inserted into the outside of the thermal-transfer head 93.

In such a state, if the fixture 141 is pulled out after the insertion, since a frictional force between the bobbins 134, 138 and the feeding and winding sides 91A and 91B is larger than a special frictional force between the shafts 143, 144 and the feeding and winding sides 91A and 91B, the feeding side 91A and the winding side 91B of the ink ribbon 91 are held by the bobbins 134, 138 of the printer 73 to be left by friction, and the ink ribbon 91 is automatically hooked on the guide pins 137, 138 and the thermal-transfer head 93. Thus, since the ink ribbon 91 is mounted on the fixture 141 beforehand in a state similar to the mounting state on the printer, and the fixture 141 is inserted into the printer 73 in this state to transfer the ink ribbon 91 to the printer 73 side, mounting work is facilitated, and it is possible to eliminate inconvenience of wrinkles or shifting of the ink ribbon 91 during mounting.

Especially, since the shafts 143, 144 of the fixture 141 are freely moved in the direction of being pulled out of the feeding side 91A and the winding side 91B of the ink ribbon 91, it is possible to transfer the ink ribbon 91 only by pulling out the fixture 141 after it is inserted into the printer 73.

Next, description will be made of an operation of the medicine feeding device 1 of the present invention which is constituted in the foregoing manner. It is assumed that the opening/closing states 53, 53 are closed in a power input state. It is also assumed that each shelf 3 to which the tablet case 3 for storing the medicine is attached in the case storage section 8 of the upper structure 7A as described above.

When an operator enters proscription data from the personal computer based on doctor's prescription, the controller of the medicine feeding device 1 specified a tablet case 3 in which a medicine designated based on the prescription data is stored, and drives the drum motor to rotate the discharge drum, and discharges medicines one by one in this way. The discharged medicines are detected by the medicine detection sensor, and counted. Then, the drum motor is stopped at a stage in which a predetermined amount is discharged. Each discharged medicine enters the chute 32 constituted of the passage 9 from the discharge chute of the tablet case 3, and temporarily received by the opening/closing plate 53.

Then, the controller opens the opening/closing plate 53 to drop the medicine in the hopper 54. The medicine dropped in the hopper 54 is moved out of the bottom end opening 54*a* to enter the nozzle 74, and received on the first shutter plate 128 of the closed shutter 126 as shown in FIG. 10. Then, the controller opens the first shutter plate 128 by the driving means as described above to pass the medicine through the wrapping paper guide 123 and enter the wrapping paper 72. Then, after the wrapping by the wrapping machine 13 as described above, the medicine is delivered to the outside from the take-out port 82. At this time, at a point of time when the medicine is dropped from the opening/closing plate 53 in the hopper 54, the controller executes medicine discharging to shorten a wrapping time. It is additionally assumed that the printing for indicating the medicine to be wrapped is carried out by the printer 73 before the feeding of the medicine.

As described above, according to the present invention, the medicine feeding device for wrapping the medicine discharged from the tablet case in the wrapping paper comprises the tablet case which stores the medicine, the wrapping paper wound in the roll state, and the tension application mechanism which applies tension to the continuously pulled-out wrapping paper. The tension application mechanism is freely moved up and down to apply the tension to the pulled-out wrapping paper by its own weight. Thus, the tension applied to the wrapping paper is not affected by the moving position of the tension application mechanism.

Therefore, always constant tension can be uniformly applied to the continuously pulled-out wrapping paper wound in the roll state, and occurrence of wrinkles or cutting can be effectively prevented.

According to the present invention, since the tension application mechanism comprises the operation section for depressing the wrapping paper, the roller disposed in the operation section, and the up-and-down direction guide with which the roller is engaged to slide, the operation section and roller are smoothly moved along the guide to apply always constant stable tension to the wrapping paper.

According to the present invention, the medicine feeding device for feeding the medicine discharged from the tablet case which stores the medicine comprises the nozzle for discharging the medicine from the tablet case, and the shutter rotatably disposed in the nozzle to open/close the medicine feeding passage. The shutter comprises the first shutter plate which has a dimension to close the nozzle, and which is rotated, and the second shutter plate connected to the tip of the first shutter plate to be freely swung. Thus, especially when the outlet of the medicine dropping passage in the nozzle is narrower than the inlet, if the medicine clogs the nozzle, the second shutter plate is swung in conjunction with the rotation of the first shutter plate of the shutter to move the medicine which has caused the clogging or break the posture.

Thus, it is possible to effectively eliminate the nozzle clogging by the medicine. Especially since the second shutter plate abuts on the narrowed place of the medicine dropping passage in the nozzle to be swung in conjunction with the rotation of the first shutter plate, it is possible to effectively eliminate the medicine-clogging of the nozzle by a simple constitution.

According to the present invention, since the tapered guide through which the medicine can be passed is disposed in the nozzle tip for feeding the medicine discharged from the tablet case in the wrapping paper, the nozzle can be easily inserted into the wrapping paper by using this guide shape.

Since the wrapping paper can be held in the bulged state by the guide, occurrence of wrinkles or slackening becomes difficult. Especially, it is possible to effectively prevent wrapping failures even if a large amount of medicines is fed.

If the nozzle can be slid from the upper surface to the far side, the replacing work of the wrapping paper and the work of inserting the nozzle into the wrapping paper can be further facilitated.

According to the present invention, the medicine feeding device for wrapping the medicine discharged from the tablet case in the wrapping paper comprises the tablet case which stores the medicine, the wrapping paper wound in the roll state, and the wrapping paper delivery mechanism which delivers the wrapping paper. The wrapping paper delivery mechanism has the base plate for holding the wrapping paper, and the engaging shaft projected from the center of the base plate to be engaged with the shaft tube around which the wrapping paper is wound. The engaging projection is formed on the side face of the engaging shaft, which is inclined to intersect the engaging shaft at the predetermined angle in the axial direction. The engaging groove is formed on the inner surface of the shaft tube, which is inclined to be engaged with the engaging projection. Thus, the wrapping paper can be mounted on the base plate by inserting the engaging shaft into the shaft tube of the wrapping paper, and adjusting the engaging groove to the engaging projection and rotating it to screw in.

Thus, the mounting workability of the wrapping paper is improved. Especially, the engagement between the engaging projection of the engaging shaft and the engaging groove of the shaft tube can effectively prevent the falling-off of the wrapping paper.

According to the present invention, in addition to the above, since the engaging projection is extended from the tip of the engaging shaft toward the base plate while being inclined in the rotational direction of the engaging shaft, the rotation when the wrapping paper is pulled out is applied in the direction of fastening the engagement between the engaging projection and the engaging shaft. Thus, it is possible to surely prevent the falling-off of the wrapping paper even if the height dimension of the engaging shaft is set small to improve mountability.

According to the present invention, since the wrapping paper delivery mechanism has the guide plate disposed to receive the wrapping paper corresponding to the lower side of the base plate, even if the engaging shaft is disposed to project horizontally or obliquely upward, the mounting work can be carried out after the wrapping paper is mounted on the guide plate to facilitate positioning. Additionally, since the tip of the engaging shaft is tapered, the shaft tube of the wrapping paper can be guided to the engaging shaft by using this tapered shape, and the position is further facilitated.

According to the present invention, the medicine feeding device for wrapping the medicine discharged from the tablet case in the wrapping paper comprises the tablet case which stores the medicine, the wrapping paper wound in the roll state, the printer which prints on the wrapping paper by the thermal transfer using the ink ribbon, and the ink ribbon mounting fixture. The ink ribbon mounting fixture comprises the feeding side shaft and the winding side shaft arranged in the fixture main body in the positional relation of corresponding to the ink ribbon feeding side bobbin and the ink ribbon winding side bobbin of the printer in the state of being opposite the printer. The feeding side of the ink ribbon is detachably attached to the feeding side shaft, and the winding side of the ink ribbon is detachably attached to the winding side shaft. Thus, when the ink ribbon is mounted on the printer, the feeding side and the winding side of the ink ribbon are detachably attached to the feeding side shaft and the winding side shaft of the fixture main body beforehand, the ink ribbon is mounted on the fixture in a state similar to that of mounting on the printer beforehand, and the fixture is inserted into the printer in this state to enable transfer of the ink ribbon to the printer side. Therefore, the mounting of the ink ribbon is facilitated, and it is possible to prevent inconvenience of wrinkles or shifting of the ink ribbon during mounting.

Additionally, according to the present invention, since the guide shaft is disposed in the fixture main body, on which the ink ribbon is hooked in the state in which the feeding side of the ink ribbon is attached to the feeding side shaft, and the winding side of the ink ribbon is attached to the winding side, the ink ribbon can be mounted on the fixture in a state much similar to the mounting state on the printer. Thus, the mounting workability can be further improved.

Furthermore, according to the present invention, the feeding side shaft and the winding side shaft are held in the fixture main body so as to freely move in the direction of being pulled out of the feeding side and the winding side of the ink ribbon in the state of abutting on the ink ribbon feeding side bobbin and the ink ribbon winding side bobbin. Thus, when the fixture on which the ink ribbon is mounted is inserted into the printer, the feeding side and the winding side of the ink ribbon are held by the ink ribbon feeding and winding side bobbins of the printer to be left, and the feeding side shaft and the winding side shaft of the fixture are pushed out to the bobbins to be pulled out of the feeding side and the winding side of the ink ribbon. Thus, the ink ribbon can be transferred only by pulling out the fixture after it is inserted into the printer. Therefore, the mounting work can be further facilitated.

What is claimed is:

1. A medicine feeding device which comprises a tablet case for storing a medicine and wrapping paper wound in a roll disposed on an attaching plate to wrap the medicine discharged from the tablet case, the medicine feeding device comprising:

a tension application mechanism for applying predetermined tension to the wrapping paper as it is continuously being pulled from the roll, the tension application mechanism comprising an operation section having a base from which a rod extends for engaging and depressing the wrapping paper, a roller mounted on said base; and a rail on the attaching plate on which the roller is rotatably slidably engaged, wherein said operation section is upward and downward movable as said roller rolls on said rail with said rod engaging and applying tension to the pulled-out wrapping paper by the weight of said operation section.

2. The medicine feeding device according to claim 1 wherein said rod has a dimension longer than the width of the wrapping paper pulled out from the roll.

* * * * *